US010711518B2

(12) United States Patent
McNeill et al.

(10) Patent No.: US 10,711,518 B2
(45) Date of Patent: Jul. 14, 2020

(54) SELF-CENTERING END CAPS FOR ARCHITECTURAL STRUCTURE COVERINGS

(71) Applicant: Hunter Douglas, Inc., Pearl River, NY (US)

(72) Inventors: David McNeill, Denver, CO (US); Ronald Holt, Westminster, CO (US); Stephen T. Wisecup, Longmont, CO (US)

(73) Assignee: HUNTER DOUGLAS, INC., Pearl River, NY (US)

( * ) Notice: Subject to any disclaimer, the term of this patent is extended or adjusted under 35 U.S.C. 154(b) by 156 days.

(21) Appl. No.: 15/833,459

(22) Filed: Dec. 6, 2017

(65) Prior Publication Data

US 2018/0163464 A1 Jun. 14, 2018

Related U.S. Application Data

(60) Provisional application No. 62/432,235, filed on Dec. 9, 2016.

(51) Int. Cl.
*E06B 9/42* (2006.01)
*E06B 9/388* (2006.01)

(52) U.S. Cl.
CPC ..... *E06B 9/42* (2013.01); *E06B 9/388* (2013.01)

(58) Field of Classification Search
CPC ..... E06B 9/42; E06B 9/388
USPC ..... 160/32, 34, 107, 113, 129, 130, 166.1, 160/174 R, 176.1 R, 902
See application file for complete search history.

(56) References Cited

U.S. PATENT DOCUMENTS

| | | | | |
|---|---|---|---|---|
| 7,093,643 | B2 | 8/2006 | Ikle | |
| 7,267,156 | B2 | 9/2007 | Byeon | |
| 7,588,068 | B2 | 9/2009 | Colson et al. | |
| 7,836,937 | B2 | 11/2010 | Anderson et al. | |
| 8,393,080 | B2 | 3/2013 | Ballard, Jr. et al. | |
| D753,412 | S | 4/2016 | Anderson | |
| D753,413 | S | 4/2016 | Anderson | |
| 9,357,868 | B2 | 6/2016 | Anderson et al. | |
| 2008/0149280 | A1* | 6/2008 | Smith | E06B 9/262 160/121.1 |
| 2015/0218879 | A1 | 8/2015 | Anderson | |
| 2016/0251896 | A1 | 9/2016 | Anderson et al. | |

OTHER PUBLICATIONS

Hunter Douglas Repair and Conversion Manual, Pirouette® Window Shadings EasyRise™ and UltraGlide® Lifting Systems, 2010.
Pirouette® V3, EasyRise™ Two-On-One, 2017, Revision: Aug. 29, 2017.
Pirouette® V3, EasyRise™ Standard, 2017, Revision: Aug. 29, 2017.
Pirouette® V3, PowerView™ Standard, 2017, Revision: Aug. 29, 2017.

* cited by examiner

*Primary Examiner* — Justin V Lewis

(57) ABSTRACT

A self-centering end cap for a bottom rail of an architectural structure covering. The end cap may include a contoured top surface that is configured to contact a head rail of the architectural structure covering to deflect the end cap and hence the bottom rail and covering of the architectural structure covering toward a horizontally centered position, thus enabling the covering and the bottom rail to be fully retracted to a docked position within the head rail without impediment.

18 Claims, 11 Drawing Sheets

*(Detail from Fig. 1)*

*(Detail from Fig. 1)*

SELF-CENTERING END CAPS FOR ARCHITECTURAL STRUCTURE COVERINGS

CROSS-REFERENCE TO RELATED APPLICATIONS

This application claims priority to U.S. Provisional Patent Application Ser. No. 62/432,235, filed Dec. 9, 2016, titled "Self-Centering End Caps for Architectural Structure Coverings", the entirety of which application is incorporated by reference herein.

FIELD OF THE DISCLOSURE

The present disclosure relates generally to the field of architectural structure coverings, and relates more particularly to end caps with contoured surfaces that promote self-centering of a bottom rail of an architectural structure covering.

BACKGROUND

Architectural structure coverings may selectively cover a window, a doorway, a skylight, a hallway, a portion of a wall, etc. Generally speaking, horizontal architectural structure coverings may include a covering that can be vertically extendable and retractable (e.g., able to be lowered or raised, respectively, in a vertical direction) relative to a horizontally-oriented head rail between a deployed or extended position, and a docked or retracted position for obscuring and exposing an underlying architectural structure such as a wall or an opening (such as, for example, a window). The architectural structure covering may further include a rigid bottom rail attached to a lower edge of the covering. The bottom rail may be utilized to add weight along the bottom edge of the covering to encourage the covering to drop by gravity during deployment. The head rail and the bottom rail may both include end caps affixed to the longitudinal ends thereof for providing the rails with a visually pleasing, aesthetic finish.

Commonly, a width of the head rail of the architectural structure covering, measured from an inwardly-facing surface of an end cap on one end of the head rail to an inwardly-facing surface of an end cap on an opposing end of the head rail, may be greater than a width of the bottom rail of the architectural structure covering, measured from an outwardly-facing surface of an end cap on one end of the bottom rail to an outwardly-facing surface of an end cap on an opposing end of the bottom rail. Thus, when the covering is retracted to its retracted, docked position, the ends caps of the bottom rail may pass between the end caps of the head rail and the bottom rail may be hidden behind the head rail in an aesthetically pleasing manner.

When a covering is being retracted to its retracted, docked position, it is not uncommon for the covering to become "skewed" as a result of one side of the covering being retracted more quickly than the other side of the covering, due to uneven rolling of the covering, or due to the head rail being mounted in a non-level window or on a non-level wall. This may cause the covering to be displaced horizontally such that the bottom rail is horizontally misaligned or off-center relative to the head rail. Thus, instead of the ends caps of the bottom rail passing between the end caps of the head rail during retraction, one of the end caps of the bottom rail may collide with a respective end cap on the head rail, thereby preventing the covering and the bottom rail from being fully retracted to the retracted, docked position.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

Disclosed herein is an improved end cap for an architectural structure covering. The architectural structure covering may include a head rail, a bottom rail, and a covering extending between the head rail and the bottom rail. The end cap is configured to fit on either end of the bottom rail and may include: an outer surface; an inner surface; a side surface disposed between the outer and inner surfaces and including an upper portion; and a self-centering feature for contacting the head rail of the architectural structure covering during retraction of the covering to center the bottom rail (e.g., horizontally) within the head rail. The self-centering feature may be integrally formed with the upper portion of the end cap. The self-centering feature may include a contoured flange extending from the upper portion of the end cap. The contoured flange may include a contoured top surface that slopes inwardly away from the outer surface of the end cap. The contoured flange may include a contoured top surface that slopes outwardly away from the covering.

The present disclosure is also directed to a self-centering architectural structure covering. The architectural structure covering may include a head rail assembly having first and second head rail ends; first and second head rail end caps operatively associated with the first and second head rail ends, respectively; a bottom rail having first and second bottom rail ends; first and second self-centering end caps operatively associated with the first and second bottom rail ends, respectively; and a covering extending between the head rail assembly and the bottom rail, the covering being selectively movable between an extended, deployed position and a retracted, docked position. In use, when the covering and the bottom rail are being selectively moved from the extended, deployed position to the retracted, docked position, in an unskewed configuration, the first and second end caps pass between the first and second head rail end caps. While, when the covering and the bottom rail are being selectively moved from the extended, deployed position to the retracted, docked position, in a skewed configuration, one of the first and second end caps contacts one of the first and second head rail end caps to center the covering and the bottom rail with respect to the head rail assembly, such as horizontally.

The first and second self-centering end caps may include an outer surface; an inner surface; a side surface disposed between the outer and inner surfaces, the side surface including an upper portion; and a self-centering feature configured to contact the first and second head rail end caps, respectively, during retraction of the covering and the bottom rail to center (e.g., horizontally) the bottom rail within the head rail assembly when in the retracted, docked position. The self-centering feature may include a contoured flange extending from the upper portion of the first and second end caps. The contoured flange may include a contoured top surface that slopes inwardly away from the outer surface of the end caps. The contoured flange may include a contoured top surface that slopes outwardly away from the covering. The first and second self-centering end caps may be coupled to the first and second bottom rail ends, respectively. The first and second end caps may include retention members extending from an inner surface thereof, the retention members being insertable into the first and second ends of the bottom rail. Alternatively, the first and second self-centering end caps may be integrally formed with the first and second bottom rail ends, respectively.

The head rail assembly may include a roller tube, the covering being selectively windable about the roller tube as the covering is selectively moved between the extended, deployed position and the retracted, docked position. In the retracted, docked position, the bottom rail may be retracted into the head rail assembly.

The present disclosure is also directed to a method for self-centering an architectural structure covering. The method may include the steps of selectively moving a covering of the architectural structure covering from an extended, deployed position to a retracted, docked position, when the covering and the bottom rail are in an unskewed configuration such that a bottom rail of the architectural structure covering is substantially parallel to a head rail of the architectural structure covering; passing the bottom rail between the head rail; and when the covering and the bottom rail are in a skewed configuration such that a bottom rail of the architectural structure covering is skewed with respect to the head rail, contacting one of a first end cap and a second end cap associated with the bottom rail with one of a first end cap and a second end cap associated with the head rail to center (e.g., horizontally) the covering and the bottom rail with respect to the head rail.

In the skewed configuration, one of the end caps associated with the bottom rail may become vertically aligned with one of the end caps associated with the head rail. Further movement of the covering from the extended, deployed position to the retracted, docked position may cause one of the first end cap and the second end cap associated with the bottom rail to contact one of the first end cap and the second end cap associated with the head rail to displace the end cap and the bottom rail, such as by aligning the bottom rail horizontally toward a horizontal center C of the covering. The end caps associated with the bottom rail may include a contoured top surface that contacts a lower surface of the end cap associated with the head rail so that continued vertical movement of the bottom rail causes the contoured top surface of the end cap to deflect the bottom rail toward the horizontal center C of the covering. In addition, as the contoured top surface of the end caps contact the lower surface of the end cap associated with the head rail, continued vertical movement of the bottom rail may also cause the contoured top surface of the end cap to deflect the bottom rail and thus align the bottom rail in the front (e.g., toward the room) to back (e.g., toward the wall) direction.

DETAILED DESCRIPTION

Figure 1:
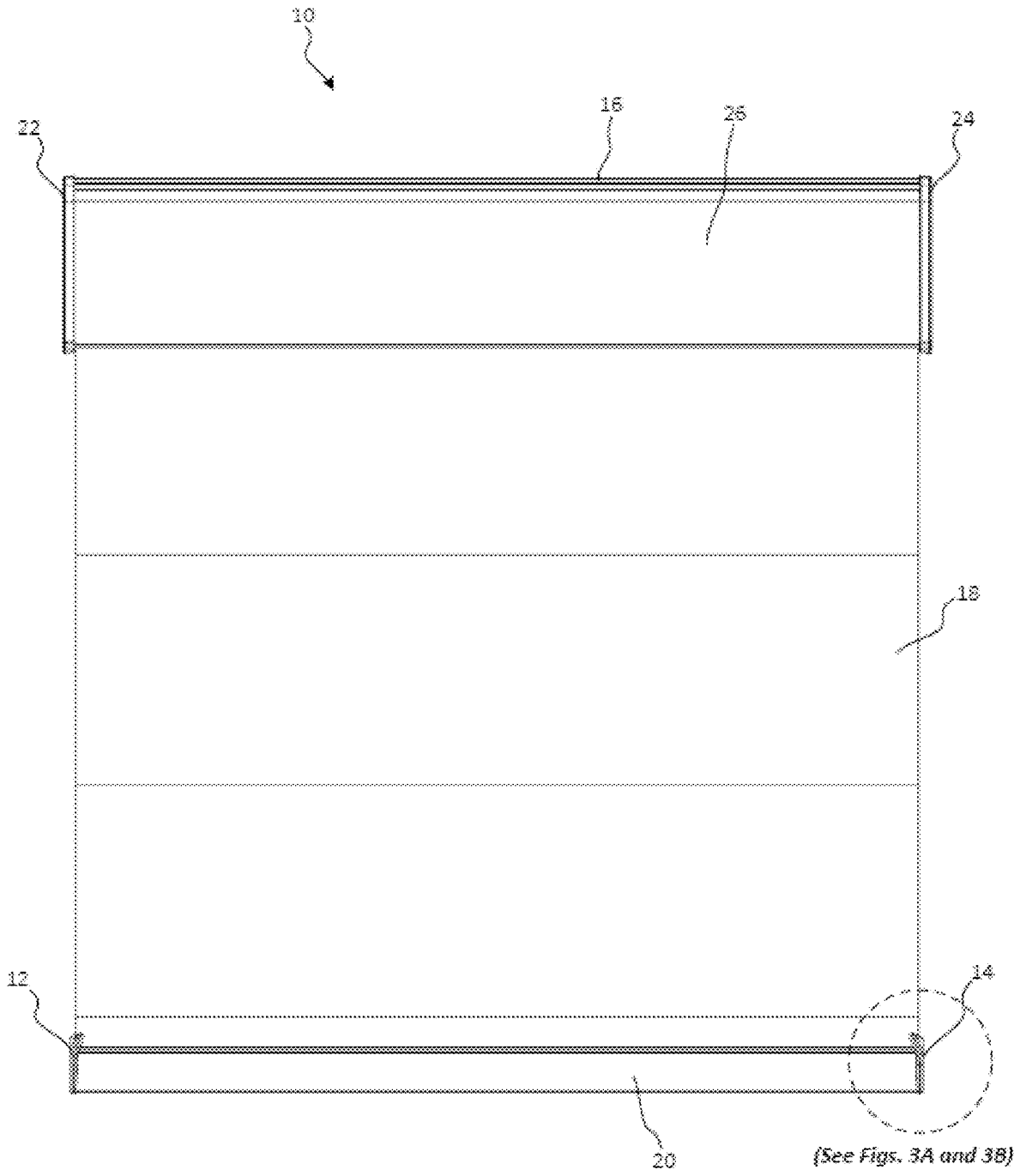
FIG. 1 is a front view illustrating an architectural structure covering in accordance with an illustrative embodiment of the present disclosure, wherein a covering of the architectural structure covering is in an extended, deployed position.

Embodiments of self-centering end caps for architectural structure coverings in accordance with the present disclosure will now be described more fully hereinafter with reference to the accompanying drawings, in which preferred embodiments of the present disclosure are presented. The end caps of the present disclosure may, however, be embodied in many different forms and should not be construed as being limited to the embodiments set forth herein. Rather, these embodiments are provided so that this disclosure will convey certain exemplary aspects of the end caps to those skilled in the art. In the drawings, like numbers refer to like elements throughout unless otherwise noted.

As will be described in greater detail below, the end caps of the present disclosure may be configured to center a bottom rail of an architectural structure covering relative to a head rail of the architectural structure covering, such as centering the bottom rail horizontally, so that the bottom rail can be fully retracted to a retracted, docked position and hidden behind or within the head rail even if a covering of the architectural structure covering becomes skewed during retraction thereof. In addition, the end caps of the present disclosure may be configured to center the bottom rail of the architectural structure covering relative to the head rail of the architectural structure covering in the front (e.g., toward the room) to back (e.g., toward the wall) direction.

Referring to FIG. 1, a front view of an architectural structure covering 10 equipped with self-centering end caps 12, 14 (hereinafter "the end caps 12, 14") in accordance with an illustrative, non-limiting embodiment of the present disclosure is shown. For the sake of convenience and clarity, terms such as "front," "rear," "top," "bottom," "up," "down," "vertical," and "horizontal" may be used herein to describe the relative placement and orientation of various components and portions of the architectural structure covering 10 and the end caps 12, 14, each with respect to the geometry and orientation of the architectural structure covering 10 and the end caps 12, 14 as they appear in FIG. 1. Said terminology will include the words specifically mentioned, derivatives thereof, and words of similar import.

The architectural structure covering 10 may include a head rail 16, a covering 18, and a bottom rail 20. The head rail 16 may be configured to be mounted to a wall or other structure above a window, doorway, skylight, hallway, or other portion of a wall in a conventional manner that will be recognized by those of ordinary skill in the art. The head rail 16 may include end caps 22, 24 (hereinafter "the head rail end caps 22, 24) disposed on opposing longitudinal ends thereof. The head rail end caps 22, 24 may be removably fastened to, or integrally formed with, the head rail 16, and may be provided for imparting a visually pleasing, aesthetic finish to the head rail 16.

As will be readily appreciated by one of ordinary skill in the art, the covering 18 of the architectural structure covering 10 may be suspended from the head rail 16 and may be configured to be vertically extended and retracted relative to the head rail 16 between an extended, deployed position (shown in FIG. 1), wherein the covering 18 may partially or entirely cover a window, a doorway, a skylight, a hallway, a portion of a wall, etc., and a retracted, docked position (shown in FIG. 4), wherein the covering 18 and the bottom rail 20 may be retracted into, and substantially hidden within, the head rail 16 (e.g., behind a fascia 26 of the head rail 16). The covering 18 depicted in the figures may be constructed of a fabric material of a conventional type that will be recognized by those of ordinary skill in the art. However, as will become apparent below, the end caps 22, 24 of the present disclosure may be implemented in conjunction with any type of covering 18, constructed from any type of material. For example, the covering 18 may be constructed from a plastic material, a vinyl material, a wood material, a metal material, etc. Furthermore, the covering 18 may be any type of covering, for example, a pleated shade, a Roman style shade, a Venetian blind, a roller shade, a stackable style, a cellular style, slats, hurricane shutters, etc. According to the illustrative embodiment illustrated in FIG. 1, the covering 18 is a rollable style fabric. In addition, the end caps 22, 24 of the present disclosure may be implemented in conjunction with a manually-actuated or motorized architectural structure covering that is amendable to having a bottom rail affixed to a lower edge thereof.

Figure 2A:
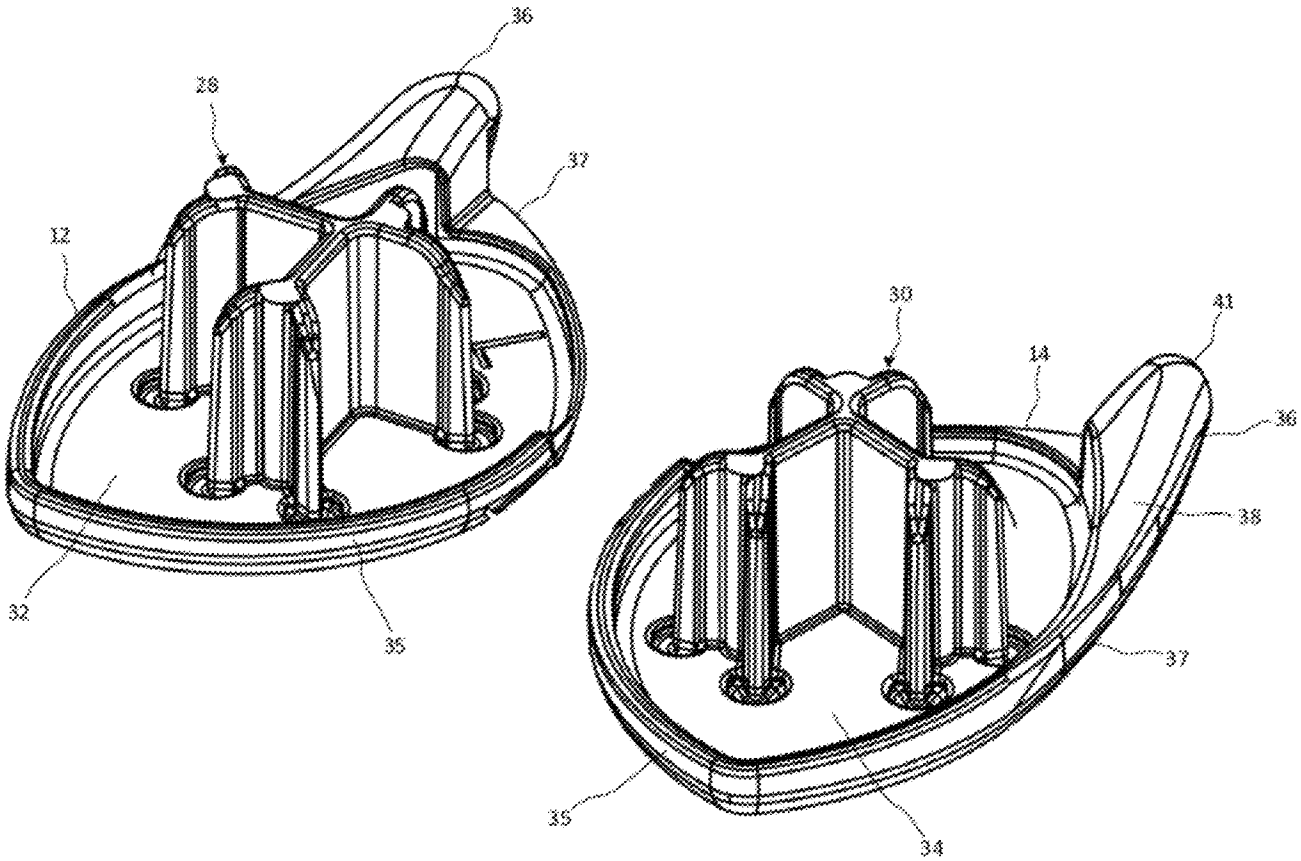
FIG. 2A is a perspective view illustrating a pair of end caps in accordance with an illustrative embodiment of the present disclosure.
Figure 2B:
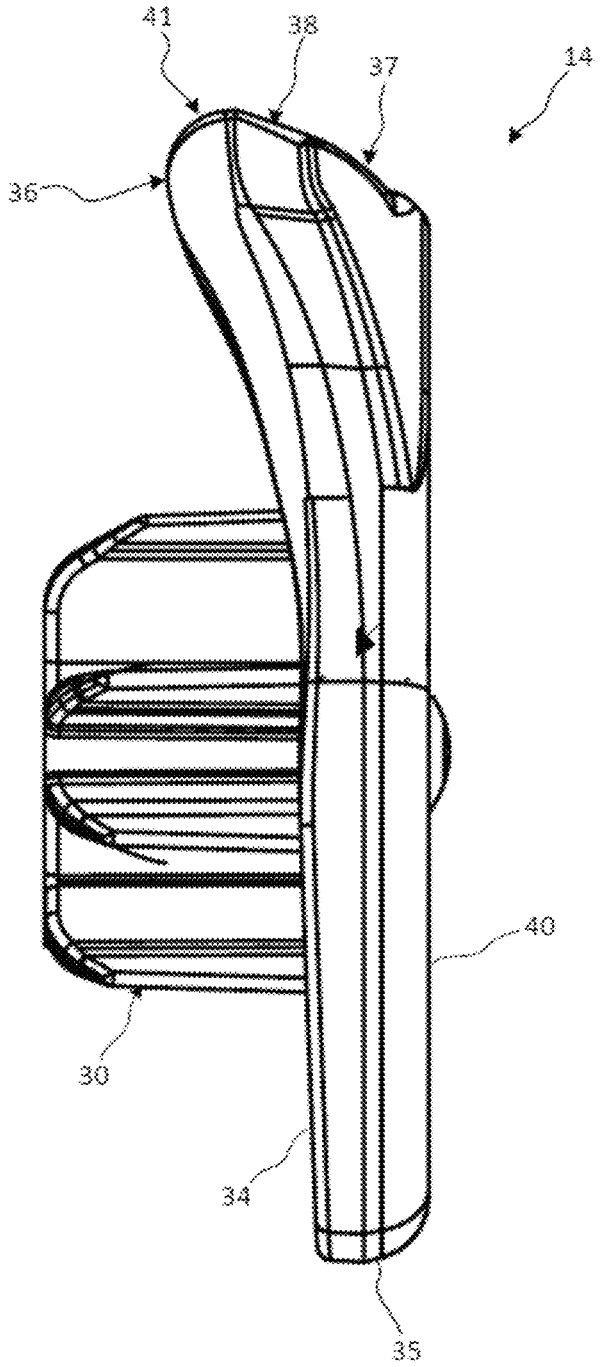
FIG. 2B is a side view of one of the end caps shown in FIG. 2A.
Figure 2C:
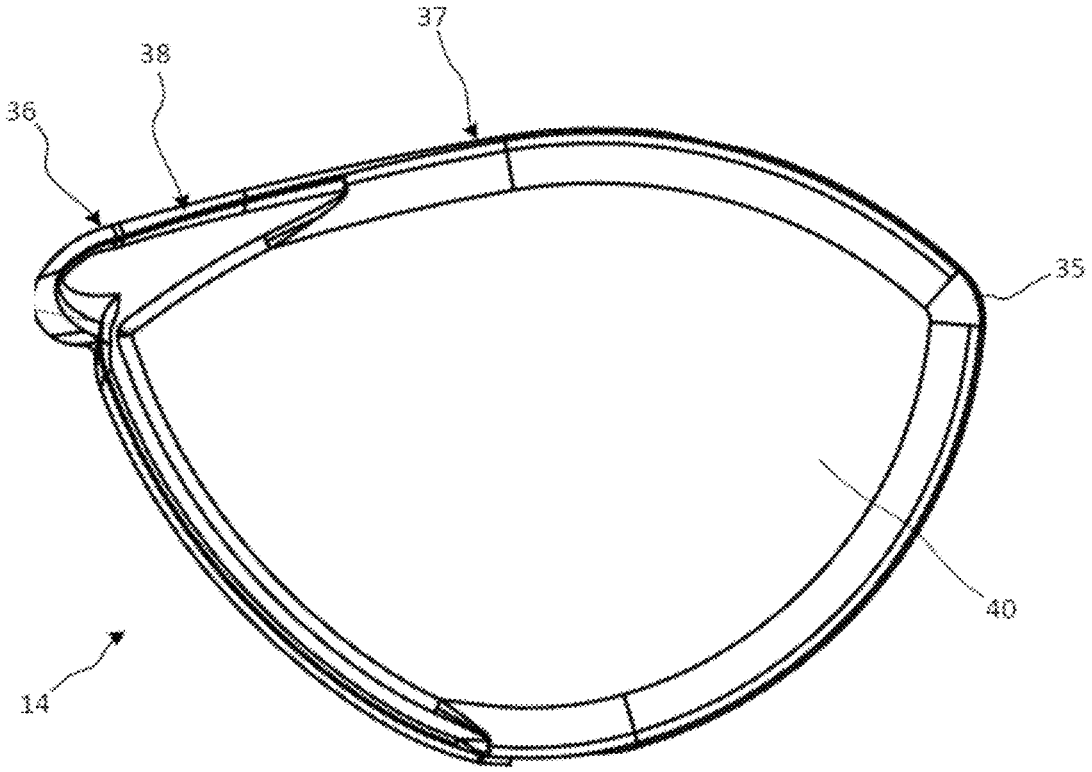
FIG. 2C is a front view of one of the end caps shown in FIG. 2A.

The bottom rail 20 may be a rigid, elongate member that is affixed to a bottom edge of the covering 18. Generally speaking, the bottom rail 20 provides a user a convenient location or "touchpoint" at which the user may engage the covering 18, for example, to pull up or down on the bottom rail to raise or lower the covering, respectively. Depending on the operating system used, the bottom rail 20 may also be provided to add weight to the lower edge of the covering 18 to encourage the covering 18 to drop by gravity from the head rail 16 during deployment. The end caps 12, 14 may be disposed on opposing longitudinal ends of the bottom rail 20. In some embodiments, the end caps 12, 14 may be integral portions of the bottom rail 20 (e.g., formed as part of the bottom rail 20 during manufacture thereof). In other embodiments, the end caps 12, 14 may be affixed to the ends of the bottom rail 20 using mechanical fastening means. For example, referring to FIGS. 2A and 2B, the end caps 12, 14 may include respective retention members 28, 30 extending from respective inner surfaces 32, 34 thereof. The retention members 28, 30 may be configured to be inserted into hollow ends of the bottom rail 20 and held therein via friction fit, snap fit, etc. between the retention members 28, 30 and an interior surface of the bottom rail 20. The embodiments of the present disclosure are not limited in this regard, and it is contemplated that the end caps 12, 14 may be engaged to the bottom rail 20 in any conventional manner known in the art.

Figure 3A:
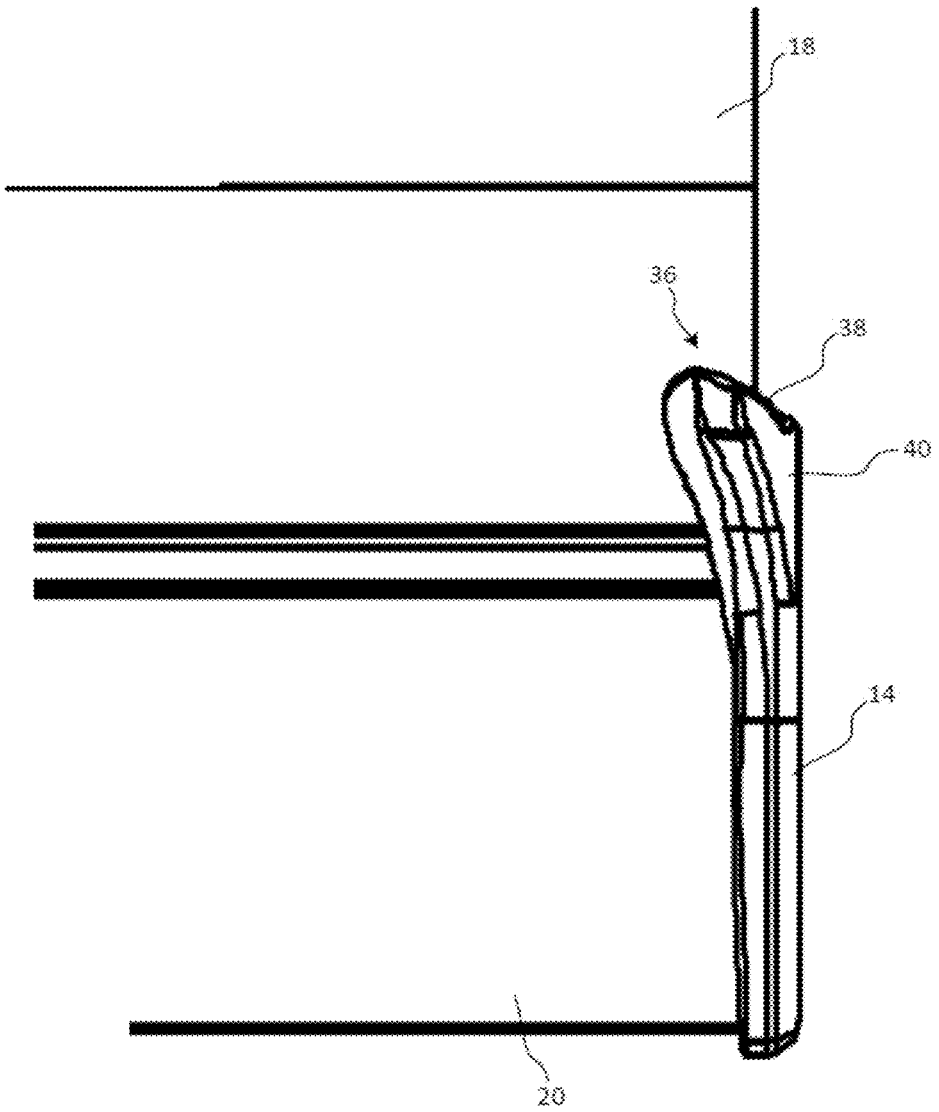
FIG. 3A is a detail view illustrating an end cap and surrounding portions of the architectural structure covering shown in FIG. 1.
Figure 3B:
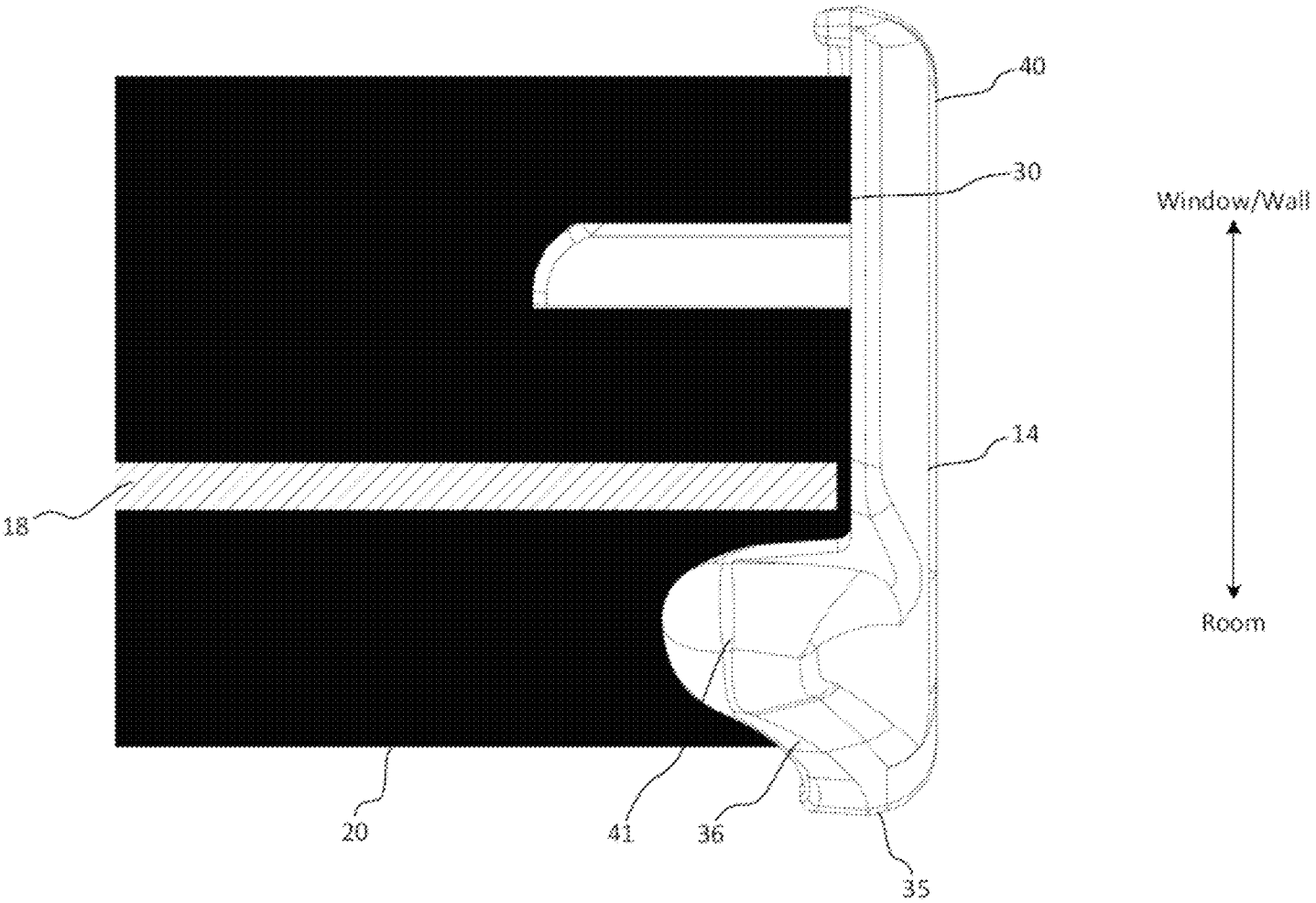
FIG. 3B is a detail, top view illustrating an end cap and surrounding portions of the architectural structure covering shown in FIG. 1.

Referring now to FIG. 3A, a detail front view illustrating the end cap 14 and surrounding structure of the architectural structure covering 10 is shown. The end cap 14 is substantially identical to, but a mirror image of, the end cap 12 shown in FIG. 1. Thus, for the sake of convenience and clarity, only the end cap 14 will be described in detail below. It will be understood, however, that the following description shall also apply to the end cap 12, with references to horizontal orientation being reversed with respect thereto.

Referring to FIGS. 2A, 2B, 2C, 3A and 3B, the end cap 14 may include an inner surface 34, a side surface 35, and an outer surface 40. The side surface 35 may be disposed between the outer surface 40 and the inner surface 34. The side surface 35 may include an upper portion 37 (i.e., an upper portion 37 of the end cap 14 when the end cap 14 is operatively installed on the bottom rail 20 as illustrated in FIG. 3A). In addition, as previously mentioned, the end cap 14 may include a retention member 30 extending from the inner surface 34 thereof for engaging the bottom rail 20 or otherwise retaining the end cap 14 in engagement with the bottom rail 20. The end cap 14 may also include a self-centering feature 36 extending from (e.g., integral with) the upper portion 37 thereof. The self-centering feature 36 of the end cap 14 may be in the form of a flange extending from the upper portion 37 of the end cap 14. The flange or self-centering feature 36 may include an angled or contoured top surface 38 that slopes inwards away from an outer surface 40 of the end cap 14. In addition, referring to FIG. 3B, the flange or self-centering feature 36 of the end cap 14 may extend outwards (e.g., towards the room) away from the covering 18. The top surface 38 may be flat or curved, or may include both a flat portion and a curved portion. The top surface 38 may also be substantially smooth to prevent the end cap 14 from catching or grabbing anything during retraction. In addition, the smooth top surface may end in a rounded nose. That is, in use, the initial contact point between the endcap 14 and the head rail end cap 24 preferably occurs with the top surface 38 of the self-centering feature 36. As such, the top surface 38 of the self-centering feature 36 preferably is substantially smooth to prevent the endcap 14 from getting caught on anything.

In the illustrative embodiment, the contoured top surface 38 of the end cap 14 may reside in-front-of the covering 18 (e.g., towards the room) and thus visible to the end user, however it is also contemplated that the contoured top surface 38 may extend in the opposite direction (for example, towards the window and away from the interior room).

Figure 2D:
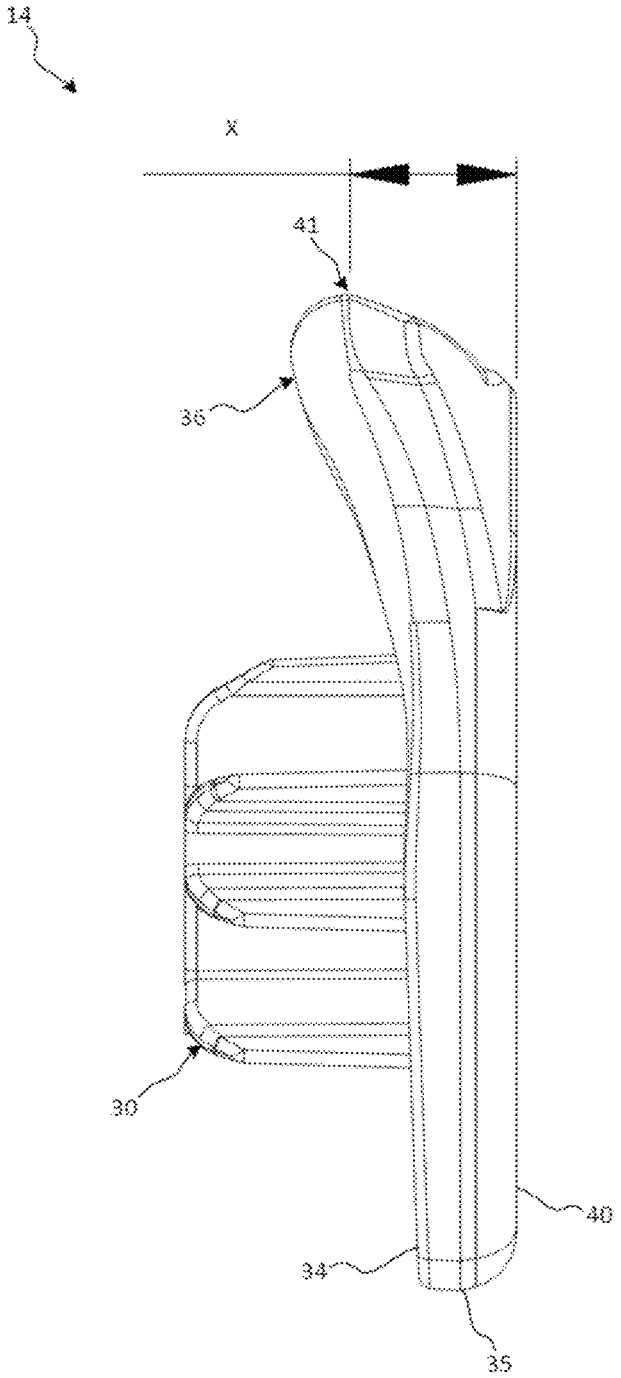
FIG. 2D is an alternate side view of the end cap shown in FIG. 2B, illustrating the aesthetical considerations when designing the self-centering feature.
Figure 2E:
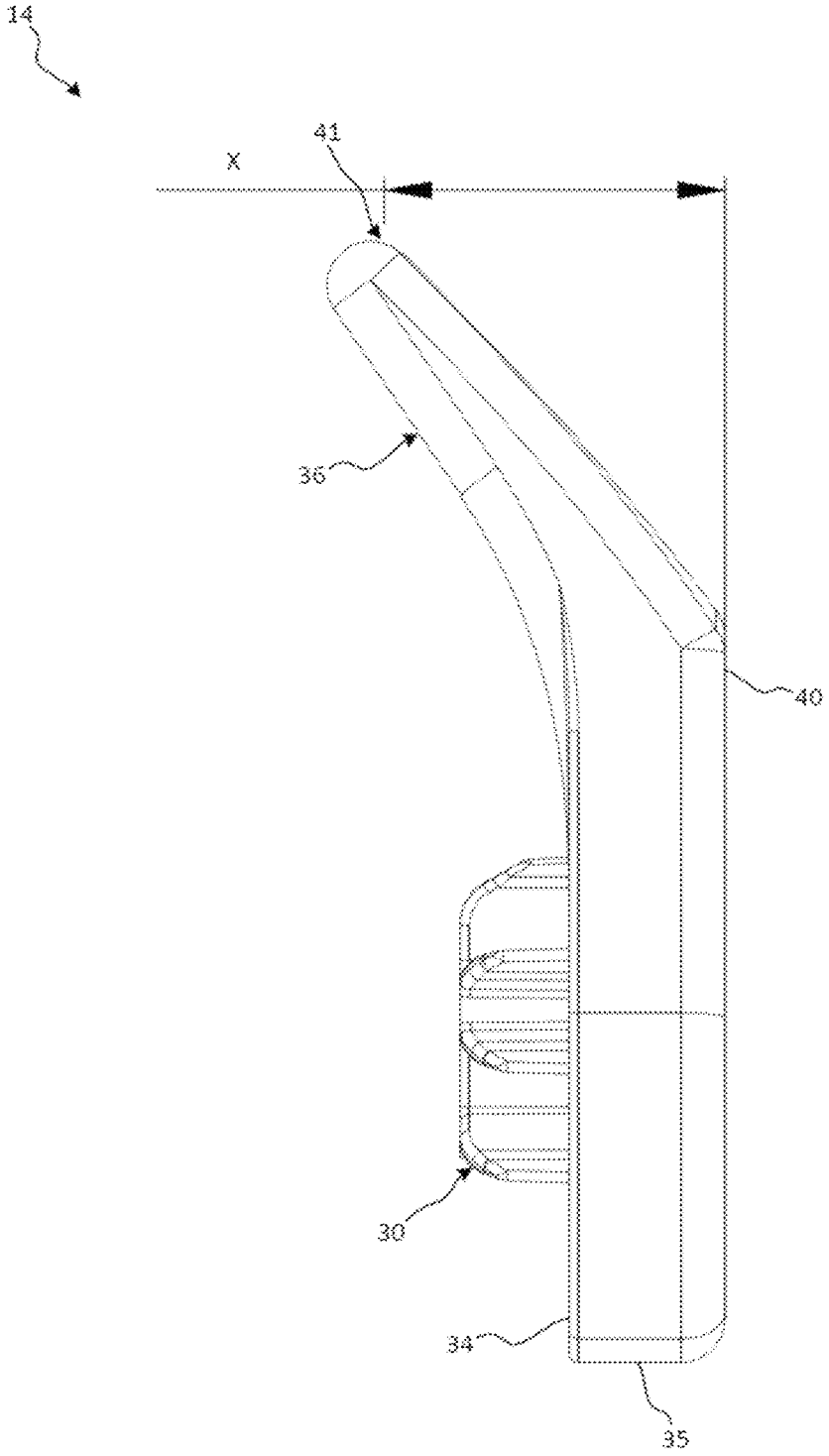
FIG. 2E is an alternate side view of the end cap shown in FIG. 2B, illustrating the aesthetical considerations when designing the self-centering feature.

Referring to FIGS. 2D and 2E, in designing the endcap 14, the larger the distance X from the tip of the flange 41 (e.g., region at which end cap 14 first contacts the head rail end cap 24 or other element to commence centering the bottom rail 20) to the outer surface 40 of the end cap 14, the greater the amount of skew of the covering 18 that can be handled. However, this should be balanced with aesthetics consideration. (e.g., the greater the distance X from the tip 41 of the self-centering flange 36 to the outer surface 40, the more visible the self-centering feature 36 becomes to the end user). For example, a comparison of FIG. 2D and FIG. 2E illustrates the different aesthetics associated with the self-centering flange 36 as the distance X is varied. FIG. 2D illustrates a distance X of approximately 0.21 inches. FIG.

2E illustrates a distance X of approximately 0.55 inches. In use, providing a larger distance X enables the self-centering flange 36 to handle an increased amount of skew in the covering 18, however as the distance X increases, the height of the self-centering flange 36 increases at a greater rate. Increasing the height of the self-centering flange 36 generally has a negative impact on aesthetics. It should be understood that the dimensions for distance X are for informational purposes only, are illustrative to illustrate the balance required for handling skew and aesthetics, and non-limiting. The distance X can be any dimension or increment of those provided.

While the flange or self-centering feature 36 has been illustrated and described as being part of the end cap 14 associated with the bottom rail 20, it is also contemplated that the flange or self-centering feature 36 can be located on the head rail end cap 24. In this embodiment, the flange or self-centering feature 36 may extend downwards (e.g., away from the head rail 16) and outwards (e.g., towards the room) to contact and guide the endcap of the bottom rail 20.

The purpose and functionality of the self-centering feature 36 will be described in detail below.

Figure 4:
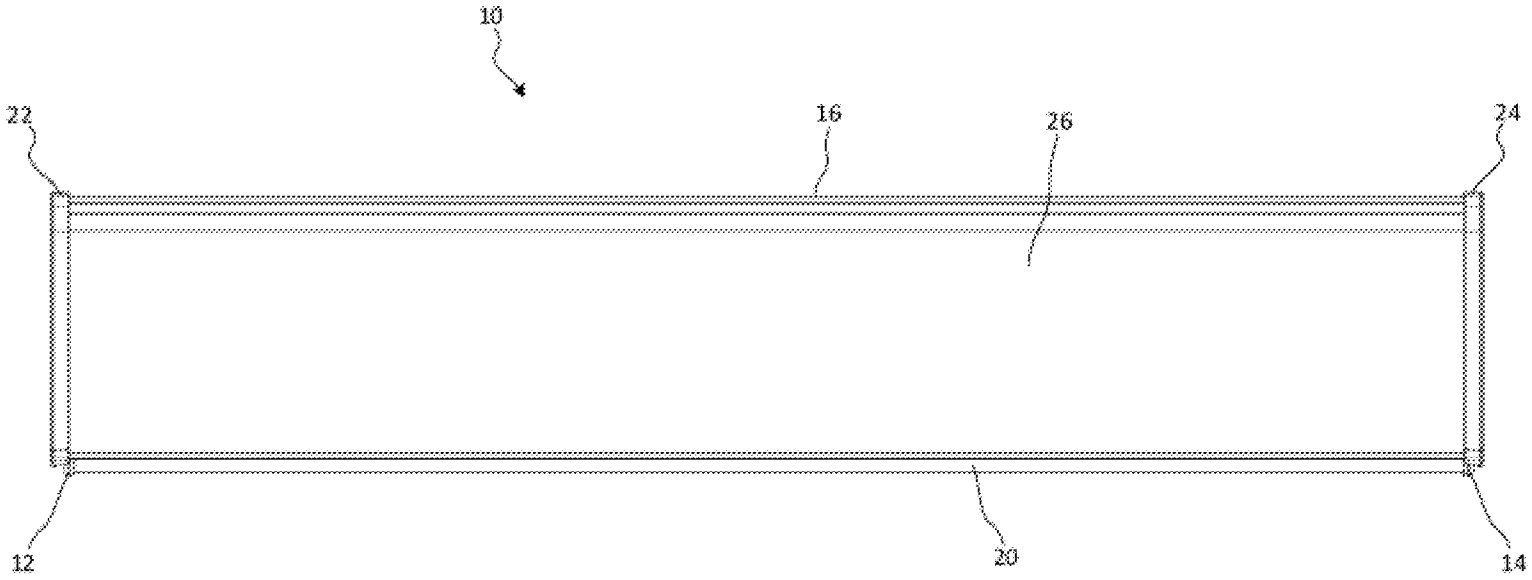
FIG. 4 is a front view illustrating the architectural structure covering shown in FIG. 1 with the covering of the architectural structure covering in a retracted, docked position.
Figure 5:
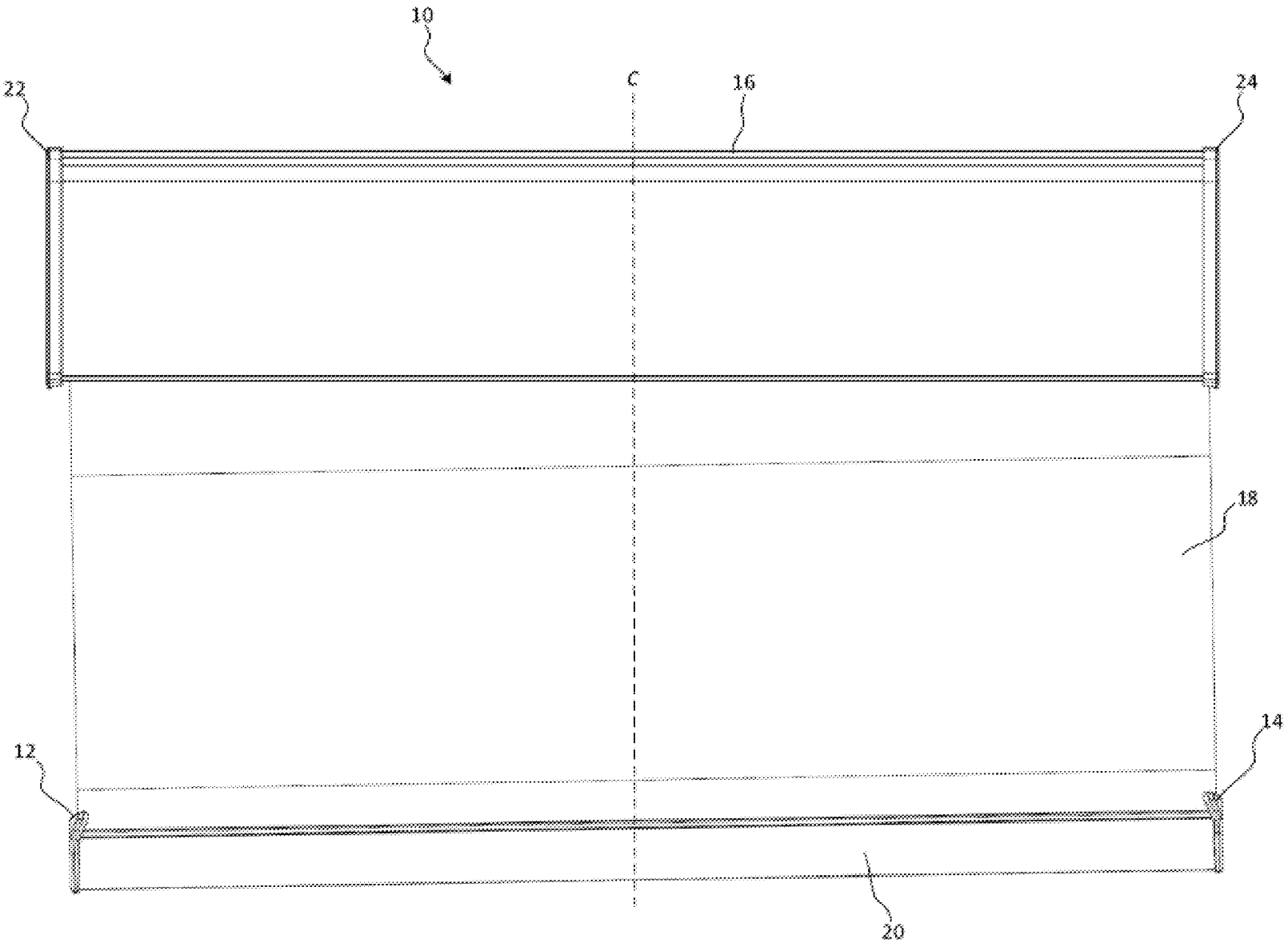
FIG. 5 is a front view illustrating the architectural structure covering shown in FIG. 1 with the covering of the architectural structure covering in a skewed, partially retracted position.

During normal operation of the architectural structure covering 10, the covering 18 and the bottom rail 20 may be retracted from the extended, deployed position shown in FIG. 1 to the retracted, docked position shown in FIG. 4. While being retracted, the bottom rail 20 may maintain a substantially parallel orientation relative to the head rail 16, and the end caps 12, 14 may pass between (i.e., inside of) the head rail end caps 22, 24 without contacting or colliding therewith before arriving at the retracted, docked position within the head rail 16. In some instances, however, the covering 18 may become "skewed" as a result of one side of the covering 18 being retracted more quickly than the other side, due to uneven rolling of the covering (e.g., fabric covering), or due to the head rail being mounted in a non-level window or on a non-level wall, as shown in FIG. 5. Such skewing may cause the bottom rail 20 to be horizontally displaced away from a horizontal center C of the architectural structure covering 10. For example, as shown in FIG. 5, the bottom rail 20 has been displaced to the right as a result of the right side of the covering 18 being retracted more quickly than the left side of the covering 18. Resultantly, the end cap 14 has become vertically aligned with the head rail end cap 24. Thus, when the covering 18 is further retracted as shown in FIG. 6, the end cap 14 may contact or collide with the head rail end cap 24, instead of bypassing the head rail end cap 24 as occurs during normal, unskewed retraction of the covering 18.

Figures 6A, 6B:
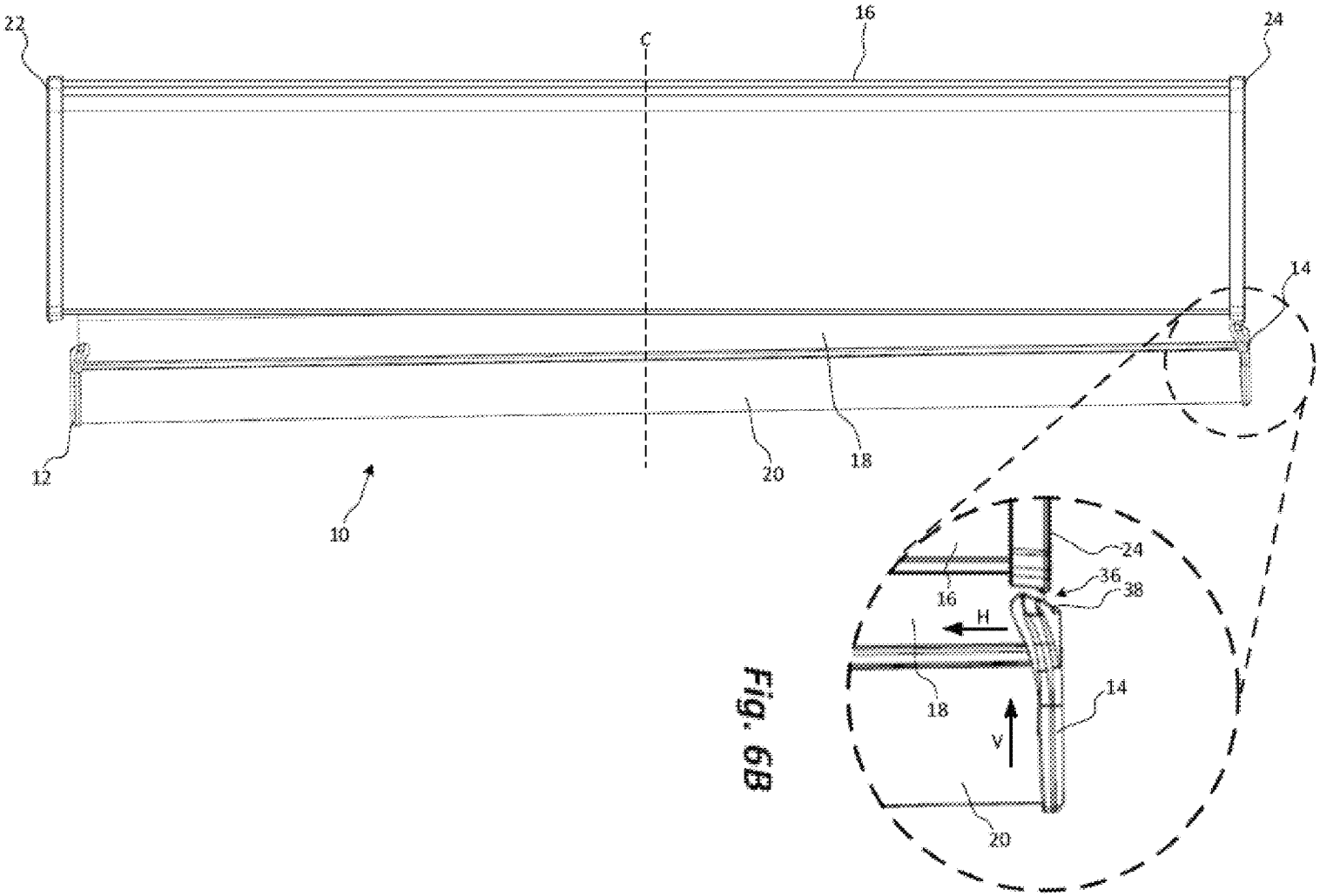
FIG. 6A is a front view illustrating the architectural structure covering shown in FIG. 1 with the covering of the architectural structure covering in a skewed, almost fully retracted position.
FIG. 6B is a detail view illustrating an end cap and surrounding portions of the architectural structure covering shown in FIG. 6A.

In architectural structure coverings having conventional bottom rail end caps (i.e., without the self-centering feature 36 of the present disclosure), the collision depicted in FIG. 6 may impede further retraction of the covering 18, preventing the covering 18 and the bottom rail 20 from being stowed in a fully retracted, docked position (FIG. 4) and leaving the covering 18 and the bottom rail 20 in an unsightly, skewed disposition. However, due to the self-centering feature 36 of the present disclosure, vertical engagement between the end cap 14 and the head rail end cap 24 may result in automatic horizontal displacement of the end cap 14 and the bottom rail 20 toward the horizontal center C of the architectural structure covering 10. Particularly, as the covering 18 and the bottom rail 20 are further retracted as indicated by the vertical arrow V in FIG. 6B, the contoured top surface 38 of the end cap 14 may engage a lower surface of the head rail 24 and, through such engagement and continued vertical movement of the end cap 14, the contoured top surface 38 may deflect the end cap 14 and the bottom rail 20 toward the horizontal center C of the architectural structure covering 10 as indicated by the horizontal arrow H in FIG. 6B. Thus, the end cap 14 may slide against and around the inside edge of the head rail end cap 24, whereby the end cap 14 may bypass the head rail end cap 24 as occurs during normal, unskewed retraction of the covering 18, and the covering 18 and the bottom rail 20 may continue to be retracted to the retracted, docked position without restriction. In addition, the end caps 12, 14 may be configured to center the bottom rail 20 of the architectural structure covering 10 relative to the head rail 20 of the architectural structure covering in the front (e.g., toward the room) to back (e.g., toward the wall) direction. That is, contact of the contoured top surface 38 of the end cap 14 and the lower surface of the head rail 24 may also deflect the end cap 14 and the bottom rail 20 to center the bottom rail 20 relative to the head rail 20 in the front (e.g., toward the room) to back (e.g., toward the wall) direction.

The foregoing discussion has been presented for purposes of illustration and description and is not intended to limit the disclosure to the form or forms disclosed herein. For example, various features of the disclosure may be grouped together in one or more aspects, embodiments, or configurations for the purpose of streamlining the disclosure. However, it should be understood that various features of the certain aspects, embodiments, or configurations of the disclosure may be combined in alternate aspects, embodiments, or configurations. Moreover, the following claims are hereby incorporated into this Detailed Description by this reference, with each claim standing on its own as a separate embodiment of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

The use of "including," "comprising," or "having" and variations thereof herein is meant to encompass the items listed thereafter and equivalents thereof as well as additional items. Accordingly, the terms "including," "comprising," or "having" and variations thereof are open-ended expressions and can be used interchangeably herein.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

All directional references (e.g., proximal, distal, upper, lower, upward, downward, left, right, lateral, longitudinal, front, back, top, bottom, above, below, vertical, horizontal, radial, axial, clockwise, and counterclockwise) are only used for identification purposes to aid the reader's understanding of the present disclosure, and do not create limitations, particularly as to the position, orientation, or use of this disclosure. Connection references (e.g., attached, coupled, connected, and joined) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another. The drawings are for purposes of illustration only and the dimensions, positions, order and relative sizes reflected in the drawings attached hereto may vary.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. An end cap for an architectural structure covering, the architectural structure covering having a head rail, a bottom rail and a covering extending between the head rail and the bottom rail, the end cap comprising:

an outer surface;

an inner surface;

a side surface disposed between the outer and inner surfaces;

an upper portion;

a lower portion; and a self-centering feature including a flange extending upwardly from the upper portion of the end cap and inwardly away from the outer surface of the end cap, the flange being configured to contact the head rail of the architectural structure covering during retraction of the covering to horizontally center the bottom rail within the head rail.

2. The end cap of claim 1, wherein the self-centering flange is integrally formed with the upper portion of the end cap.

3. The end cap of claim 1, wherein the self-centering flange is a contoured flange comprising a smooth top surface and a rounded nose.

4. The end cap of claim 3, wherein the contoured flange includes a contoured top surface.

5. The end cap of claim 4, wherein the contoured top surface slopes outwardly away from the covering.

6. The end cap of claim 1, wherein the inner surface includes a retention member extending therefrom, the retention member being insertable into an end of the bottom rail for securing the end cap to the bottom rail.

7. A self-centering architectural covering comprising:

a head rail assembly having first and second head rail ends;

first and second head rail end caps operatively associated with the first and second head rail ends, respectively;

a bottom rail having first and second bottom rail ends;

first and second self-centering end caps operatively associated with the first and second bottom rail ends, respectively, each of the first and second self-centering end caps including an outer surface, an inner surface, an upper portion, a lower portion, and a flange extending upwardly from the upper portion of the end cap and inwardly away from the outer surface of the end cap;

a covering extending between the head rail assembly and the bottom rail, the covering being movable between an extended position and a docked position;

wherein, when the covering and the bottom rail are moved from the extended position to the docked position, in an unskewed configuration, the first and second end caps pass between the first and second head rail end caps; and wherein, when the covering and the bottom rail are moved from the extended position to the docked position, in a skewed configuration, one of the flanges on the first and second end caps contacts one of the first and second head rail end caps to horizontally center the covering and the bottom rail with respect to the head rail assembly.

8. The architectural covering of claim 7, wherein the flanges each include a contoured top surface.

9. The architectural covering of claim 8, wherein the contoured top surface slopes outwardly away from the covering.

10. The architectural covering of claim 7, wherein the first and second self-centering end caps are coupled to the first and second bottom rail ends, respectively.

11. The architectural covering of claim 10, wherein each of the first and second end caps include retention members extending from the inner surface thereof, the retention members being insertable into the first and second ends of the bottom rail.

12. The architectural covering of claim 7, wherein the first and second self-centering end caps are integrally formed with the first and second bottom rail ends, respectively.

13. The architectural covering of claim 7, wherein the head rail assembly includes a roller tube, the covering being windable about the roller tube as the covering is moved between the extended position and the docked position.

14. The architectural covering of claim 13, wherein, in the docked position, the bottom rail is retracted into the head rail assembly.

15. A method for self-centering an architectural structure covering comprising:

moving a covering of the architectural structure covering from an extended position to a docked position;

when the covering and the bottom rail are in an unskewed configuration such that a bottom rail of the architectural structure covering is substantially parallel to a head rail of the architectural structure covering, passing the bottom rail between the head rail; and when the covering and the bottom rail are in a skewed configuration such that a bottom rail of the architectural structure covering is skewed with respect to the head rail, contacting one of a first end cap and a second end cap associated with the bottom rail with one of a first end cap and a second end cap associated with the head rail; each of the first and second end caps associated with the bottom rail including an outer surface, an inner surface, an upper portion, a lower portion, and a flange extending upwardly from the upper portion of the end cap and inwardly away from the outer surface of the end cap, the flange being arranged and configured to contact one of the first and second end caps associated with the head rail to horizontally center the covering and the bottom rail with respect to the head rail.

16. The method of claim 15, wherein, in the skewed configuration, one of the end caps associated with the bottom rail is vertically aligned with one of the end caps associated with the head rail.

17. The method of claim 16, wherein further movement of the covering from the extended position to the docked position causes one of the first end cap and the second end cap associated with the bottom rail to contact one of the first end cap and the second end cap associated with the head rail to horizontally displace the end cap and the bottom rail toward a horizontal center C of the architectural structure covering.

18. The method of claim 17, wherein the flanges of the end caps associated with the bottom rail include a contoured top surface that contacts a lower surface of the end cap associated with the head rail so that continued vertical movement of the bottom rail causes the contoured top surface to deflect the bottom rail toward the horizontal center C of the architectural structure covering.

* * * * *